United States Patent [19]

Decker et al.

[11] Patent Number: 4,941,232

[45] Date of Patent: Jul. 17, 1990

[54] SLIP RESISTANT, CUSHIONING COVER FOR HANDLES

[75] Inventors: Richard B. Decker, Vermilion; Joseph Hummel, Amherst, both of Ohio

[73] Assignee: Bettcher Industries, Inc., Birmingham, Ohio

[21] Appl. No.: 106,247

[22] Filed: Oct. 7, 1987

[51] Int. Cl.[5] ..... B25G 1/10

[52] U.S. Cl. ..... 16/111 R; 16/111 A; 16/114 R; 16/116 R; 16/DIG. 12; 74/551.9; 273/75; 273/81 B; 273/81.2; 81/489; 30/276

[58] Field of Search ..... 16/111 R, 116 A, 116 R, 16/114 R, DIG. 12, 114 A, 114 B, 110 R, 111 A, DIG. 18, DIG. 19; 74/551.9; 273/75, 81 B, 81 D, 81 R, 165, 81.2, 73 J, 67 DB; 30/340, 341, 517, 276; 81/177.1, 427.5, 489

[56] References Cited

U.S. PATENT DOCUMENTS

| | | | |
|---|---|---|---|
| 2,655,963 | 10/1953 | Dell | 273/75 |
| 4,004,476 | 1/1977 | De Vrou | 16/116 R |
| 4,098,506 | 7/1978 | Gaiser | 273/75 |
| 4,185,375 | 1/1980 | Brown | 273/75 |
| 4,347,280 | 8/1982 | Lau et al. | 273/75 |
| 4,637,140 | 1/1987 | Bettcher | 30/276 |
| 4,685,189 | 8/1987 | Palmqvist et al. | 74/551.9 |
| 4,702,006 | 10/1987 | McCullough | 16/114 R |

FOREIGN PATENT DOCUMENTS

| | | | |
|---|---|---|---|
| 2857022 | 5/1980 | Fed. Rep. of Germany | 273/75 |
| 416791 | 5/1910 | France | 273/670 B |
| 2573315 | 5/1986 | France | 273/73 J |
| 630295 | 10/1949 | United Kingdom | 273/73 J |
| 2185209 | 7/1987 | United Kingdom | 16/111 R |

*Primary Examiner*—Nicholas P. Godici
*Assistant Examiner*—Edward A. Brown
*Attorney, Agent, or Firm*—Watts, Hoffmann Fisher & Heinke

[57] ABSTRACT

A slip-resistant, flexible, cushioning wrap for a handle comprising a laminate suitable for covering the handle. The laminate has a base layer of cushioning, non-absorbent closed-cell foam having an outer layer of washable, grip-enhancing, random and open-cell foam laminated to one side and having a pressure sensitive adhesive applied to the other side. The laminate may be formed as a sheet or a tube. A sheet of laminate may be cut to conform to the contours of the handle and then wrapped about the handle with the edges either overlapping or abutting. A tube of laminate may also be formed to fit the contours of the handle.

5 Claims, 5 Drawing Sheets

SLIP RESISTANT, CUSHIONING COVER FOR HANDLES

TECHNICAL FIELD

This invention relates to a covers for handles and more particularly to slip resistant, elastomeric covers constructed to be applied by the user and readily removable for cleaning or replacement, especially suitable for use on meat-cutting knives.

BACKGROUND ART

It is often desirable to apply a cushion-like covering to an otherwise rigid handle of an implement for improved comfort and grip. However, constructions and materials used in existing grips, especially those that can be applied and replaced by the user, are not satisfactory for many applications. In the food industry, in particular, a satisfactory slip-resistant replaceable handle cushion is needed.

Health standards in the food industry, especially the meat butchering and cutting industry, dictate a high degree of cleanliness and cleanability for equipment, including knives and other cutting tools, both hand operated and power driven. As a result, the materials used to fabricate the tools are typically non-porous, such as stainless steel, aluminum, or plastic, to minimize the foci where soil can accumulate. Power-driven hand knives, for example, typically have smooth metal or plastic handles with, perhaps, a small knurled portion to facilitate gripping by the user. The fluids and fats which result from cutting meat or other comestibles lead to slipperiness between the meat-cutter's hand or glove and the cutting tool handle.

Power tools compound the problem of slippage by contributing motor vibrations, sudden torque, and mechanical shock which can jar the tool from the operator's hand. The vibration also causes fatigue and discomfort that makes gripping the tool more difficult. Typically an operator tends to grip a slippery or vibrating tool more firmly by applying more hand pressure which leads, in the short run, to operator fatigue and, in the longer run, to occupational disabilities of the hand and forearm.

DISCLOSURE OF THE INVENTION

The invention is a cutting tool handle cover that improves an operator's grip on the tool, provides cushioning on the handle against shock, and is washable on the handle; yet also is inexpensive and easy to install and remove so it facilitates replacement when worn or permanently soiled. More particularly, the invention provides for an elastomeric covering for a handle constructed to be applied by the user and readily removable for cleaning and replacement. The covering is characterized by a non-slip surface to facilitate hand gripping under moist or oleaginous conditions; resilience sufficient to provide cushioning against mechanical shock being transmitted from the handle to the hand during use; reversible adherence to the handle to provide for non-twisting of the cover during use of the handle and further to provide for removal or replacement of the cover after use; elasticity sufficient to provide for dimensional modification of the cover so that it contacts substantially the entire surface of the handle; non-permeability to prevent fluid substances from passing through the cover to the handle; and low thermal conductivity to provide insulation against heat being conducted away from the hand to the handle during use.

In one embodiment, the covering is in the form of a thin ribbed sheath; the sheath is applied to the handle by the user by unrolling a rolled-up sheath onto the handle; a fixture to aid in rolling, unrolling and exactly positioning the sheath on the handle is provided. The sheath may be cylindrical, conical or hourglass shaped, depending upon the elasticity and the configuration of the handle to which it is applied.

In another embodiment, the covering is in the form of a ribbed and relatively rigid elastomeric sheath having a contoured wall of varying thickness to define an hourglass shape which is suitable for use with cylindrical handles. The relative rigidity of the sheath is such that it may be slipped over and onto the handle and yet stay in place on the handle during use due to the adherent nature of the elastomer.

In yet another embodiment the covering is in the form of a sheet or tube of a laminate; the sheet is preferably cut to conform to the contours of the handle to facilitate a smooth fit with opposite edges either abutting along the handle or evenly overlapping; the tube is preferably formed to fit the contours of the handle and may be split longitudinally for ease of application.

As used in the specification and the claims, "non-absorbing" means substantially resisting the absorbance of physiological fluids, such as blood and sera, as well as oils and fats; "washable" means amenable to the removal of physiological fluids, oils and fats, and imbedded fleshy or fatty particulates, which may be flushed out and carried away by the application of high pressure water, with or without detergent. "Closed-cell foam" refers to a cellular plastic having non-interconnecting cells open only on end surfaces. "Random and open-cell foam" refers to a cellular plastic having interconnecting cells randomly arranged.

The thin, ribbed sheath is formed by dipping a grooved sheath-form-matrix into liquidified elastomeric material, such as latex. Once the elastomeric material has set, it is stripped off the matrix and turned inside out to form the ribbed sheath. The ribs are, preferably, longitudinally arranged on the cylindrical sheath, have sharp edges to provide for good gripping, and are tapered at the ends so that there are no blunt corners to facilitate cleaning. In a preferred embodiment of the sheath, the ribs are rectilinear in cross-section and have a height of about 1/16 to about 3/16 of an inch. The height of the ribs determines, to an extent, the grip size, so that the larger ribs would be used by an operator with a large hand and the smaller ribs by an operator with a smaller hand. The contoured-wall, ribbed sheath is formed by being cast from a mold having longitudinal ribs. These ribs, like those on the thin, ribbed sheath, preferably have sharp edges to provide for good gripping and are tapered at the ends to facilitate cleaning. The ribs have a height of about 1/16 to ⅛ of an inch. The thickness of the contoured wall can be varied to change the grip size so that thicker walled sheaths would be used by an operator with a larger hand and thinner walled sheaths by an operator with a small hand. The thickness of the wall is preferably no less than about ⅛ of an inch at its thinnest portions to impart sufficient rigidity. The thickness of the wall is greater at the top and bottom of the sheath and greatest in the middle to define an hour-glass shape. Thus at the top and bottom, the wall should have a minimum thickness of about ¼ of an inch and at the middle a thickness of about ⅜ of an inch or more to provide for good gripping depending on the operator's hand size.

In order for the thin, ribbed sheath to be applied to a handle, especially a metallic handle, it is necessary that the sheath be rolled up into a toroid shape and then accurately unrolled onto the handle. This is so because the elastomeric nature of the sheath prevents it from being slidable over the handle. It is undesirable to fabricate the thin sheath so that it could be slipped over the handle or to lubricate the thin sheath for application because in either case, the covering would twist during use and present a safety hazard. Thus, once the sheath is on the handle, it adheres and cannot be positionally adjusted. Hence a fixture is provided to aid in application of the sheath so that the sheath is placed in the exactly desired position where it is unrolled onto the handle.

The fixture is proportioned so as to ensure exact placement of the sheath on a handle. The fixture comprises a tubular mandrel and base separable from the mandrel; the mandrel is dimensioned so that a sheath may be fairly easily slipped over it with or without lubrication; the mandrel may also have graduations at the top to aid in positioning of sheaths of different length or different thickness, e.g., a sheath thicker due to higher ribs will have a larger diameter when rolled than a thinner covering of the same length. The base is proportioned so as to accommodate an end of the handle within its circumference. In use, a sheath is slid over the tubular mandrel into a predetermined position on the mandrel, depending on the length or thickness of the sheath; the sheath is rolled from the top down into a toroid or donut shape; the toroid is then rolled onto the base. Once the rolled sheath is positioned on the base, the mandrel is removed; the handle to be covered is placed on the base; and the sheath unrolled onto the handle. Accordingly, there is provided a method of applying a thin, tubular, open-ended elastomeric handle covering of a predetermined length and/or thickness to a preselected area of a handle, the covering having a top-end and a bottom-end, the method being characterized by the steps of rolling the covering into a toroidal shape; placing the toroidally shaped covering in a first predetermined position; placing the handle in a second predetermined position; and unrolling the covering onto the handle; said first and second predetermined positions being located and arranged so that the covering is unrolled onto the preselected area of the handle. Preferably, the toroidally shaped covering is stretched radially prior to being unrolled.

The contoured-wall sheath is applied to the handle by slipping the sheath over the handle. The sheath is rigid enough so that it is slidable over the handle without lubrication, yet should lubrication be employed, the elastomer is sufficiently adherent so that the presence of lubrication does not cause the covering to twist during use.

The laminate covering of the invention has a base layer of cushioning, non-absorbent, closed-cell foam, an outer layer of washable, grip-enhancing, random and open-cell foam laminated to one side of the base layer, and a pressure sensitive adhesive applied to the other side of the base layer. In a preferred embodiment of the laminate, the base layer is a non-absorbent, cross-linked polyethylene closed-cell foam resistant to tearing, and the outer layer is a washable polyether foam about 5 ½ to 6 cells thick. This combination yields a covering for a handle wherein the base layer's closed cell structure provides cushioning for a user's hand while the outer layer's open cell structure enhances gripping. A hand tool handle, such as that of a meat trimming knife, covered with the material of the invention, is more comfortable to grip and less likely to slip from the user's hand. This construction further yields a covering for a handle in which the base layer is substantially impervious to fluids, fats and oils, and particulates that may pass through the outer layer, and in which the pervious outer layer can be easily cleaned by washing with a flow of water or a detergent solution owing to the limited depth of the outer open-cell layer which inhibits soil retention. The tear resistance of the base layer ensures that the cover will withstand the "wear-and-tear" of commercial use for a reasonable time. However, the relatively low cost and easy application of the covering facilitates frequent changing as the outer layer becomes worn.

The invention also provides a method for improving the grippability of a tool handle by covering with and adhering to the handle a flexible laminate having a base layer of non-absorbent closed-cell foam, an outer layer of washable random and open cell foam on one side of the base layer and pressure sensitive adhesive applied to the other side of the base layer. The method may be carried out by forming a sheet of the laminate and wrapping the sheet about the handle so that opposite edges either abut or overlap. The method may also be carried out by forming a tube of the laminate and applying the tube over the handle.

The above and other features and advantages of the invention will become more apparent from the detailed description that follows.

BRIEF DESCRIPTION OF THE DRAWINGS

FIG. 13 is a longitudinal-sectional view of the contoured wall sheath on a cylindrical handle shown in phantom; and FIG. 14 is a partial cross-sectional view of FIG. 13 along the line 14—14.

BEST MODE FOR CARRYING OUT THE INVENTION

Figure 1:
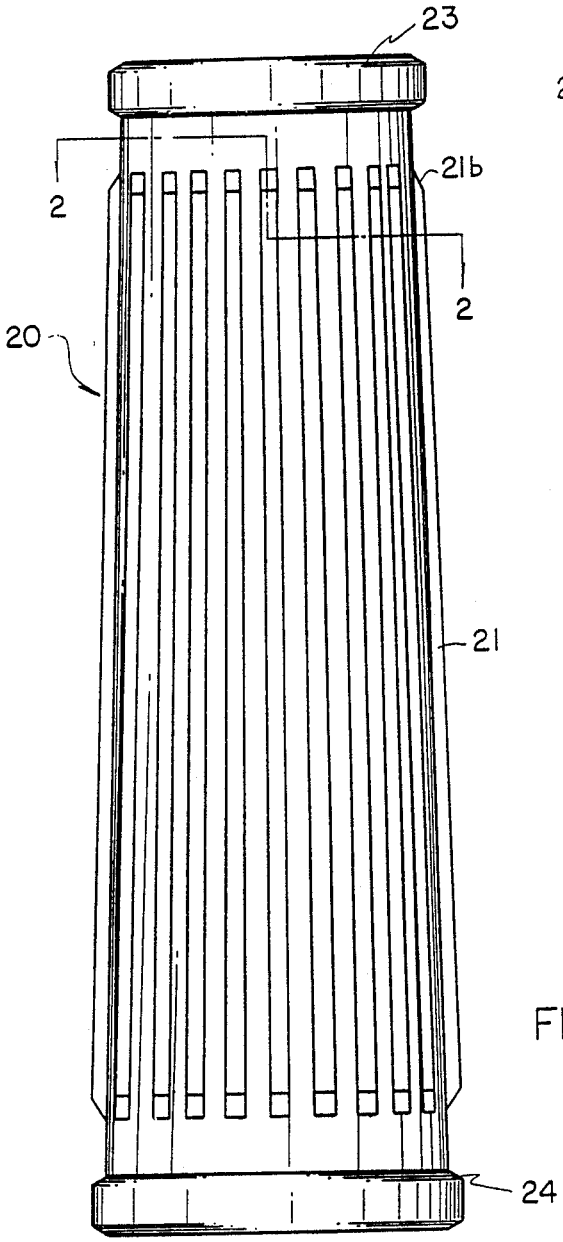
FIG. 1 is an elevational view of the thin, ribbed sheath of the invention.
Figure 2:
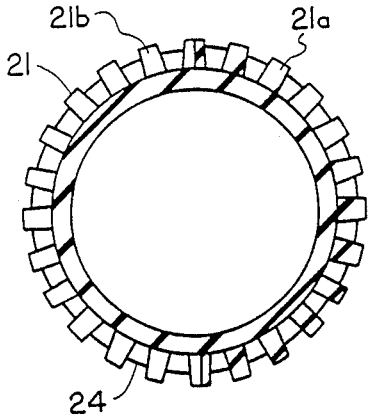
FIG. 2 is a cross sectional view of FIG. 1 along the line 2—2.

Referring to the drawings, the thin, ribbed sheath of the invention is shown generally at 20 in FIG. 1. The sheath is formed by dipping a grooved sheath-form-matrix into liquified elastomeric material such as Surtex Natural Rubber Latex, which is natural rubber latex, U.S.D.A. approved, and stripping the set latex sheath off the matrix inside out to yield the sheath 20. The grooves on the sheath-form-matrix are longitudinal so as to form longitudinal ribs 21 on the outside of the sheath. The grooves are rectilinear so as to yield sharp edges 21*a* on the ribs 21 to enhance gripping. The ends of the grooves are tapered to yield tapered rib ends as at 21*b* to facilitate cleaning of the sheath. The sheath has a top cuff 23 and a bottom cuff 24 to define the gripping area of the sheath.

Figure 3:
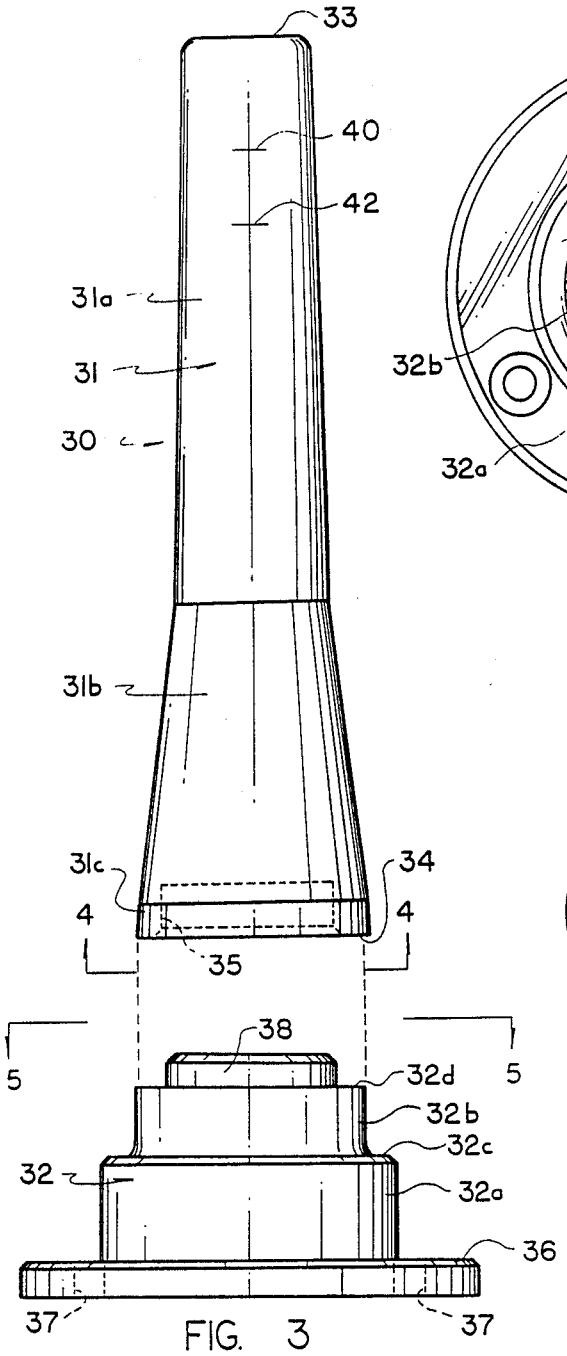
FIG. 3 is an elevational view of the fixture of the invention.
Figure 5:
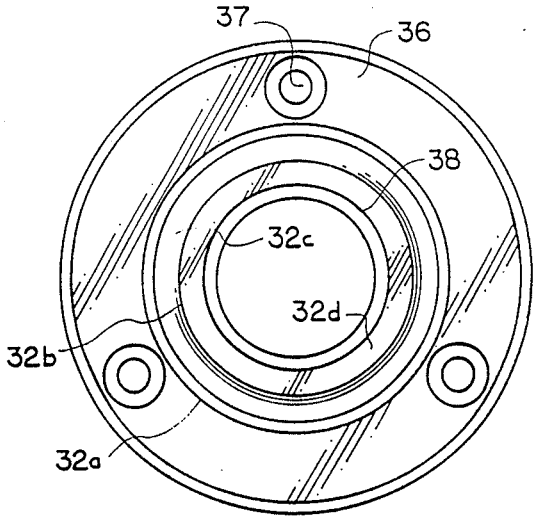
FIG. 5 is a top plan view of a part of the fixture of FIG. 3 taken from the plane 5—5 of FIG. 3.
Figure 4:
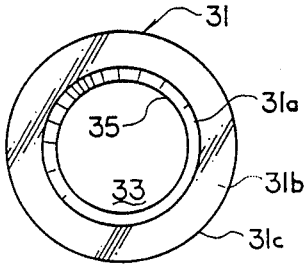
FIG. 4 is a bottom plane view of a part of the fixture of FIG. 3 taken from the plane 4—4 of FIG. 3.

FIG. 3 illustrates a fixture 30 used to roll the sheath of FIG. 1 in preparation for application to a handle. The fixture 30 comprises a mandrel 31 and a base 32. The mandrel is circular in cross section and has a first portion 31*a* that tapers slightly and uniformly, increasing its diameter, from a flat end 33 toward a second portion 31*b*. Portion 31*b* tapers and increases its diameter at a greater rate toward a third portion 31*c*, which is cylindrical. The mandrel terminates at a wide end 34, in which a recess 35 is formed. The base 32 has a bottom flange 36 with holes 37 so that the base can be affixed to a work surface by screws or bolts. Atop the bottom flange of the base 32 there is a first columnar portion 32*a* and on top of it a reduced diameter second columnar portion 32*b*. The juncture therebetween defines a rolled-sheath-stopping shoulder 32*c* which prevents the sheath from rolling beyond a predetermined number of turns, as is more fully explained below. A boss 38 extends from the reduced diameter columnar portion 32*b*, dimensioned to be closely received in the recess 35 of the mandrel 31. The juncture between boss 38 and reduced diameter columnar portion 32*b* forms a shoulder 32*d* to engage the annular end 34 of the mandrel 31.

Figure 6:
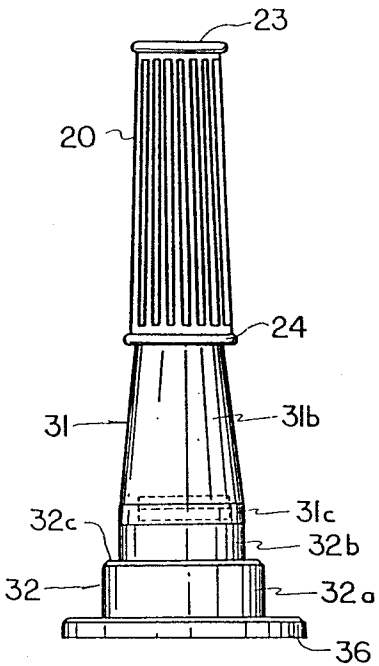
FIG. 6 is an elevational view of the thin, ribbed sheath positioned on the fixture prior to rolling.

FIG. 6 illustrates a sheath 20 that conforms in size and shape to, and which is slipped over the portion 31*a* of the mandrel 31. As illustrated, the top cuff 23 of the sheath 20 is aligned flush with the end 33. Should a thicker or shorter sheath than as illustrated in FIG. 6 be used, the top cuff 23 may be aligned with, e.g., a mark 40 or a mark 42 (FIG. 3), circumferentially enscribed or otherwise applied on mandrel 31. The distance between the rolled sheath stopping shoulder 32*c* and the tip end 33 or, e.g., mark 40 or mark 42, is predetermined according to the length and thickness of the sheath 20 so that when a particularly sized sheath 20 is rolled down the mandrel 31 until stopped by the rolled sheath stopping shoulder 32*c*, the sheath 20 will have rolled a predetermined number of turns so that it is positioned accurately for unrolling onto a handle.

Figure 8:
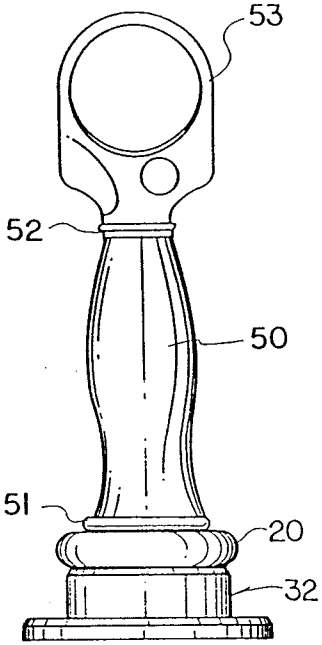
FIG. 8 is an elevational view of the sheath rolled onto the base of the fixture with the mandrel replaced by a knife handle, the sheath being positioned for unrolling onto the handle.
Figure 7:
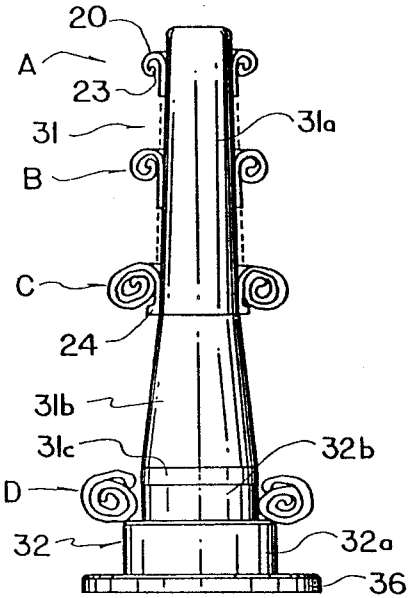
FIG. 7 is a schematic view, partially in cross-section illustrating the method of rolling the thin, ribbed sheath.

As illustrated diagrammatically in FIG. 7, the top cuff 23 of the sheath 20 is rolled down the fixture 30. Rolling is commenced as illustrated in position A; as rolling continues through position B, the top cuff 23 is enclosed within the rolled-up portion of the sheath; at position C, the sheath 20 is completely toroidal, with the bottom cuff 24 still against the surface of the mandrel. At that point the mandrel gradually expands in diameter. Further rolling of the sheath 20 down the mandrel 31 toward and onto the column portion 32*b* and against the shoulder 32*c* stretches the rolled sheath radially and is carried out so as to position the toroidal sheath with the bottom cuff 24 located as illustrated in position D, exactly at the top of portion 32*b* of the base. The radial stretching is necessary because the sheath must be in a radially stretched condition when applied to the handle to prevent subsequent slippage. When the rolled-up sheath is in position D on the base, the mandrel 31 is removed from the base and replaced by a handle, e.g., a knife handle 50, as illustrated in FIG. 8. The column portion 32*b* is essentially the same diameter and shape as the outside diameter of the base of the handle, and the boss 38 is constructed to fit closely within the base of the knife handle. A bottom end 51 of the knife handle rests on the shoulder 32*d* of the base. The bottom cuff 24, not visible in FIG. 8, is located essentially flush with the bottom 51 of the handle 50. The rolled sheath 20 is then unrolled upward so as to be placed in the exactly desired position between the bottom 51 and the top 52 of the handle 50. As previously mentioned, this arrangement is necessary because the sheath cannot be positionally adjusted once it is rolled onto the handle.

As illustrated in FIG. 8, the knife handle 50 is placed on the base 32 of the Fixture 30 so that the sheath 20 will be unrolled toward the blade end 53. This arrangement is used when the knife 50 is of the electric motor driven type having a hollow handle 50 adapted to removably receive a drive cable. Knives of this type are shown, e.g., in U.S. Pat. No. 4,439,924. With an air motor driven knife 500 the drive is not conveniently removable, but the blade end 53 can be made removable from the handle 50; and in that case the base 32 can be dimensioned to receive the top 52 of the handle 50. The sheath 20 is then rolled onto the handle in the direction starting at the top 52 rather than the bottom 51, as described above.

Figure 10:
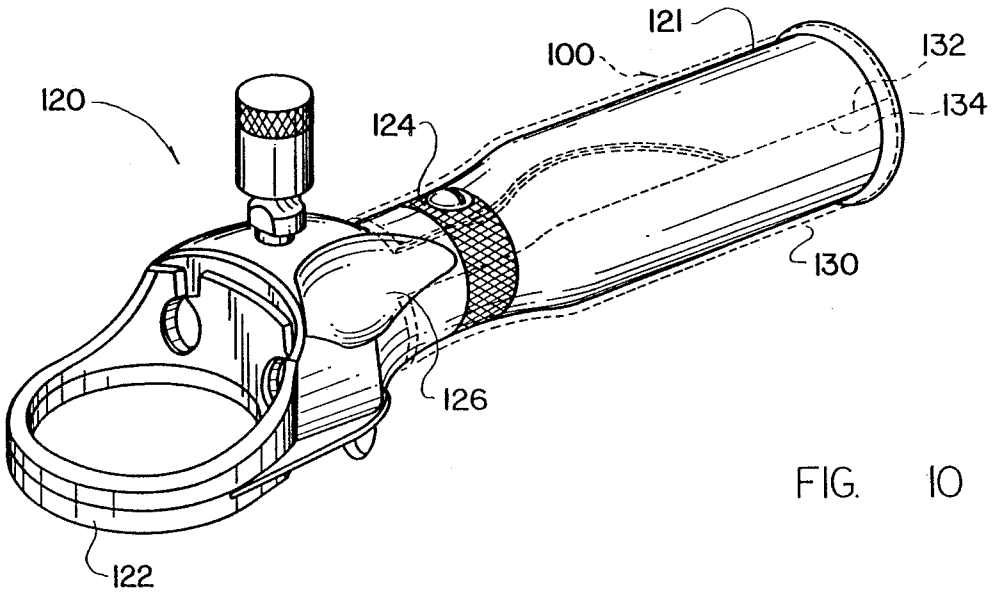
FIG. 10 is a perspective view of a motor driven trimming knife used in the meat industry with a laminate affixed and partially cut away.

Although the sheath 20 and fixture 30 are illustrated in FIG. 8 as adapted for a somewhat, tapered handle as in FIG. 10 or an hourglass shaped handle as in FIG. 8, the sheath 20 and fixture 30 can be constructed and arranged for other shapes, such as cylindrical. Where the handle is placed on the mandrel in an inverted position, the shape of the mandrel and/or the sheath may require modification, but within reasonable limits, the sheath will stretch and contract to accommodate variations.

With an appropriate hollow handle of the article to which the sheath is to be applied, the mandrel 31 need not be separable from the base 32; e.g., if the knife or other tool construction is hollow and thin walled over the length to which this cover is to be applied. In that case, the mandrel can be shaped so that when the sheath 20 is rolled to a position against the shoulder 32*c*, the hollow handle can be simply slipped over the mandrel 31 and stopped by a handle stopping portion the mandrel, formed by, e.g., an increased diameter portion on the mandrel beyond which the handle will not pass, but past which the sheath can be rolled.

Figure 9:
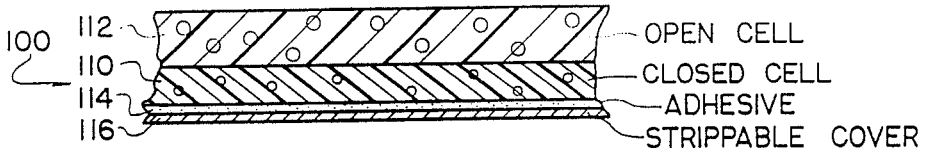
FIG. 9 is an idealized, cross-sectional diagrammatic view on an enlarged scale of the laminate of the invention.
Figure 11:
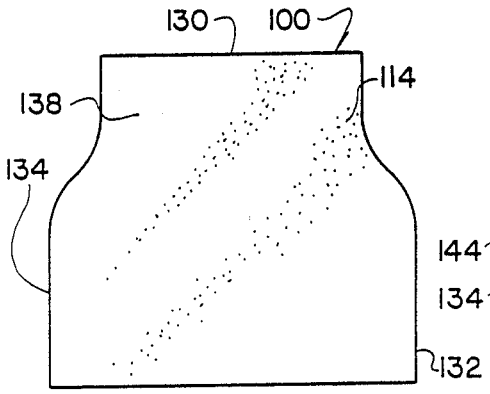
FIGS. 11 and 12 are bottom plan views of two different embodiments of the laminate shaped to fit the handle of the knife of FIG. 9 showing the surfaces that contact the handle.
Figure 12:
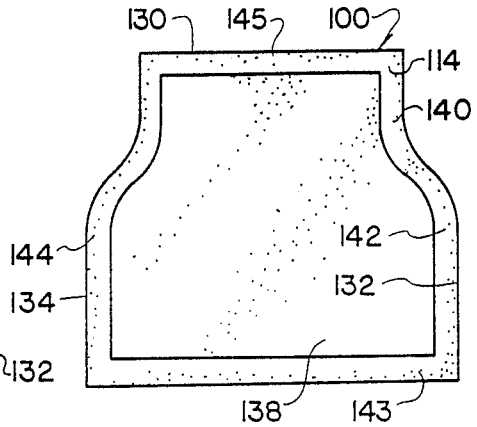

A laminate cover 100 of the invention is shown in FIGS. 9, 11 and 12, and is comprised of a foam base layer 110 of closed cells, a foam outer layer 112 of open cells adhered to the base layer, a layer of pressure sensitive adhesive 114, and a strippable cover 116 on the adhesive.

The base layer 110 is substantially non-absorbent and preferably formed of a cross-linked polyethylene. The preferred base layer has the properties shown in Table I.

TABLE I

| | |
|---|---|
| density | 2 lbs./ft.$^3$ |
| water absorbency | 0.04 lbs./ft.$^2$ of cut surface |
| compressive strength | 12–16 psi. at 50% deflection |
| tear resistance | 7–12 lb./in. |
| tensile strength | 36–55 lbs./ft.$^3$ |
| thickness | 1/16 in. |

A suitable closed-cell foam having the above properties is a type A polyethylene resin foam available as "Volara" from Stephenson & Lawyer, Inc., Grand Rapids, Mich. It has been discovered that a polyethylene foam having the properties listed in Table I tends to adhere to metal handles even without adhesive, hence providing a good degree of slip resistance.

The outer layer 112 washable and preferably formed of a polyether-polyurethane. Ideally, the outer layer has the properties shown in Table II.

TABLE II

| | |
|---|---|
| density | 1.2 lbs./ft.$^3$ |
| compressive strength | 22–27 psi. at 25% deflection |
| thickness | 3/32 in. |

A suitable polyether-polyurethane having the above properties is available as "Polyether" from Stephenson & Lawyer, Inc. "Polyether" foam has sixty cells per inch of thickness; the cells are twelve sided and about 50% of the cells are open to absorb water and other fluids. The base layer 110 is laminated to the outer layer 112 by any suitable technique known in the art, such as by vulcanizing, flame laminating or with an adhesive.

As will be appreciated, inherent surface roughness of the open-cell structure of the outer layer 112 provides a good gripping surface for an operator's hand, whether gloved or not. The preferred thickness of the outer layer 112 yields a depth of about 5¾ to 6 cells. This layer; cell depth provides adequate integrity and useful life while being thin enough for soil to be flushed out throughout the depth with high pressure water and detergent. The cell depth facilitates water and detergent reaching through the outer layer to the surface of the base layer to remove accumulated grease and particulates.

The denser closed-cell base layer 110 is essentially impervious to soil and cleaning fluids so they do not enter and accumulate in the base layer 110. The thickness of the base layer 110 provides a strong support base for the outer layer, and thermal, electrical and mechanical insulation between the handle and the operator's hand.

FIG. 10 illustrates the laminate 10 (in phantom) affixed to a trimming or boning knife 120 similar to the knife shown in FIG. 8 but of slightly different shape. The knife is constructed to receive a motor driven flexible drive cable or an air motor (not shown), in the handle 121, to drive a blade 122 in circular cutting movement, such as disclosed in U.S. Pat. No. 4,637,140. The metal handle 121 has a small knurled gripping surface 124 and a depression 126 for the operator's thumb.

The cover 100 is cut from a sheet as in FIG. 9 into a contoured piece 130, such as shown in FIGS. 11 and 12, so as to fit snuggly about the handle 121 and to follow the contours of the gripping surface 124 and the depression 126. As shown in FIG. 10, longitudinal edges 132, 134 of the contoured piece 130 preferably abut each other along the length of the handle 121 without gap or overlap to ensure adhesion of the piece to the handle and to present an integral gripping surface for the operator.

Adhesion of the piece 130 to the handle 121 is accomplished by providing adhesive 114 on an interior surface 138; it is preferred that the adhesive be applied over the entire interior surface 138 of the base layer 110, as shown in FIG. 11, so that the piece is substantially entirely in adhesive contact with the handle it wraps to ensure against tearing when torque is applied to the handle and wrap during use of the cutting tool. The adhesive 114 may alternatively be applied only as a narrow strip 140 along marginal surface portions 142, 143, 144, 145 of piece, as shown in FIG. 12. The adhesive should be continuous to integrally seal the interior surface 138 of the base layer 110 from contamination or from cleaning fluid. A preferred adhesive for application to the entire surface 138 has at least a limited degree of strechability to allow wrapping and shaping of the laminate around the handle. It should be pressure sensitive and not so adherent that the laminate cannot be purposefully peeled off in one piece. A suitable adhesive is a medical grade adhesive rubber on a strippable film paper cover 116, which is then applied to the surface 138. A suitable material for the strippable cover 116 is a polyester film paper; other suitable materials and wrap to apply an adhesive coating are known in the art.

A preferred method for making a contoured sheet such as shown in FIGS. 11 and 12 is to form a continuous web of base layer 110 having outer layer 112 vulcanized on one side and an adhesive layer 114 with its strippable cover 116 adhered to the other side, and then to cut out sheets in any desired contour by known techniques, such as die cutting.

An alternative preferred method is to form the laminate in the shape of a tube which can be slipped over or rolled onto the knife handle and adhered in place by applying pressure to the pressure sensitive adhesive.

The contoured-wall, ribbed sheath of the invention is shown generally at 150 on a handle 152 shown in phantom in FIG. 13. The contoured-wall sheath is formed by molding liquified elastomeric material in a contoured-wall-sheath-forming mold. The elastomeric material may be a natural rubber latex, such as Surtex Natural Rubber Latex which is U.S.D.A. Approved. The exterior surface 154 of the contoured-wall sheath 150 is in the form of an hour-glass while the interior surface 156 is cylindrical. The hour-glass-like shape of the exterior surface 154 is formed by varying the wall thickness from about ¼" at the top-end 158 and the bottom-end 160 to about ⅜" at the hour-glass buldge in the middle 162 with a thickness of about ⅛" at the top-waist 164 and the bottom-waist 166. Longitudinal ribs, as at 168, are rectilinear in cross-section, as best seen in FIG. 14. The contoured-wall sheath 150 is sufficiently rigid to be slipped over and onto handle 152. One advantage of the hour glass shape is that the thickness of the bulge at the middle 162 may be varied to accommodate different operator hand sizes for the same diameter handle. Another advantage of the hour-glass shape is the provision of relatively thick, i.e., about ⅛ of an inch, layer of elastomeric material beneath the ribs 168 to enhance the cushioning and shock absorbency of the sheath.

From the foregoing description of the preferred embodiments of the invention it will be apparent that the advantages of the invention heretofore enumerated and others have been accomplished and that there has been provided a slip-resistant, cushioning covering for a handle. While preferred embodiments of the invention have been described in considerable detail, various modifications or alterations may be made therein without departing from the spirit or scope of the invention set forth in the appended claims.

We claim:

1. A thin elastomeric cover for a handle constructed to be applied by the user and readily removable for cleaning and replacement, said cover characterized in that it comprises a laminated sheet suitable for wrapping about the handle and having a base layer of closed cell foam; an outer layer of open cell foam; pressure sensitive adhesive on one side of the base layer; and a strippable cover sheet on the adhesive; and further characterized by a non-slip surface to facilitate hand gripping under moist or oleaginous conditions;

resilience sufficient to provide cushioning against mechanical shock being transmitted from the handle to the hand during use;

reversible adherence to the handle to provide for non-twisting of the cover during use of the handle and further to provide for removal or replacement of the cover after use;

elasticity sufficient to provide for dimensional modification of the cover so that it contacts substantially the entire surface of the handle over which it lies;

non-permeability to prevent fluid substances from passing through the cover to the handle; and low thermal conductivity to provide insulation against heat being conducted away from the hand to the handle during use; and further characterized in that the base layer is of non-absorbent cross-linked polyethylene closed cell foam, said base layer being about 1/16 inch thick; and the outer layer is of washable polyether random and open cell foam bonded to one side of the base layer, said outer layer being about 5½ to 6 cells thick.

2. A thin elastomeric cover for a handle constructed to be applied by the user and readily removable for cleaning and replacement, said cover characterized in that it comprises a laminated sheet suitable for wrapping about the handle and having a base layer of closed cell foam; an outer layer of open cell foam; pressure sensitive adhesive on one side of the base layer; and a strippable cover sheet on the adhesive; and further characterized by: a non-slip surface to facilitate hand gripping under moist or oleaginous conditions;

resilience sufficient to provide cushioning against mechanical shock being transmitted from the handle to the hand during use;

reversible adherence to the handle to provide for non-twisting of the cover during use of the handle and further to provide for removal or replacement of the cover after use;

elasticity sufficient to provide for dimensional modification of the cover so that it contacts substantially the entire surface of the handle over which it lies;

non-permeability to prevent fluid substances from passing through the cover to the handle; and low thermal conductivity to provide insulation against heat being conducted away from the hand to the handle during use; and further characterized in that the base layer is of non-absorbent closed cell foam having a density of about 2 pounds per cubic foot, and a water absorption of about 0.04 pounds per cubic foot; and the outer layer is of washable random and open cell foam bonded to one side of the base layer, said foam having a density of about 1.2 pounds per cubic foot.

3. A thin elastomeric cover for a handle constructed to be applied by the user and readily removable for cleaning and replacement, said cover characterized in that it comprises a laminated sheet suitable for wrapping about the handle and having a base layer of closed cell foam; an outer layer of open cell foam; pressure sensitive adhesive on one side of the base layer; and a strippable cover sheet on the adhesive; and further characterized by: a non-slip surface to facilitate hand gripping under moist or oleaginous conditions;

resilience sufficient to provide cushioning against mechanical shock being transmitted from the handle to the hand during use;

reversible adherence to the handle to provide for non-twisting of the cover during use of the handle and further to provide for removal or replacement of the cover after use;

elasticity sufficient to provide for dimensional modification of the cover so that it contacts substantially the entire surface of the handle over which it lies;

non-permeability to prevent fluid substances from passing through the cover to the handle; and low thermal conductivity to provide insulation against heat being conducted away from the hand to the handle during use; and further characterized in that the base layer is of non-absorbent cross-linked polyethylene closed cell foam having a density of about 2 pounds per cubic foot, and a water absorption of about 0.02 pounds per cubic foot, said base layer being about 1/16 thick; and the outer layer of washable polyether random and open cell foam bonded to one side of the base layer, said polyether foam having a density of about 1.2 pounds per cubic foot, said outer layer being about 5½ to 6 cells thick.

4. A thin elastomeric cover for a handle constructed to be applied by the user and readily removable for cleaning and replacement, said cover characterized in that it comprises a laminated sheet suitable for wrapping about the handle and having a base layer of closed cell foam; an outer layer of open cell foam; pressure sensitive adhesive on one side of the base layer; and a strippable cover sheet on the adhesive; and further characterized by: a non-slip surface to facilitate hand gripping under moist or oleaginous conditions;

resilience sufficient to provide cushioning against mechanical shock being transmitted from the handle to the hand during use;

reversible adherence to the handle to provide for non-twisting of the cover during use of the handle and further to provide for removal or replacement of the cover after use;

elasticity sufficient to provide for dimensional modification of the cover so that it contacts substantially the entire surface of the handle over which it lies;

non-permeability to prevent fluid substances from passing through the cover to the handle; and low thermal conductivity to provide insulation against heat being conducted away from the hand to the handle during use; and further characterized in that the base layer is of non-absorbent cross-linked polyethylene closed cell foam having a density of about 2 pounds per cubic foot, has a compressive strength of 12–16 pounds per square inch at a deflection of about 50%, a tear resistance of 7–12 pounds per inch, and a water absorption of about 0.04 pounds per square foot of cut surface, said base layer being about 1/16 inch thick; and the outer layer is of washable polyether random and open cell foam bonded to one side of the base layer, said polyether foam having a density of about 1.2 pounds, and compressive strength of about 22–27 pounds per square inch at about 25% deflection, said outer layer being about 5½ to 6 cells thick.

5. In combination, a power driven rotary knife having a handle and a cover on the handle, said cover characterized by a laminate having:

a base layer of non-absorbent cross-linked polyethylene closed cell foam, said base layer being about 1/16 inch thick;

an outer layer of washable polyether random and open cell foam bonded to one side of the base layer, said outer layer being about 5½ to 6 cells thick; and adhered to the handle by pressure sensitive adhesive on the other side of the base layer.

* * * * *